United States Patent [19]

Carlson

[11] Patent Number: 4,586,041

[45] Date of Patent: Apr. 29, 1986

[54] PORTABLE CONFLICT MONITOR TESTING APPARATUS

[76] Inventor: Donald A. Carlson, 865 Wooten Dr., Kerman, Calif. 93630

[21] Appl. No.: 566,928

[22] Filed: Dec. 29, 1983

[51] Int. Cl.[4] ..... G08G 1/097

[52] U.S. Cl. ..... 340/931; 340/22; 340/515; 340/907; 371/16

[58] Field of Search ..... 340/22, 907, 931, 515, 340/661, 663; 361/86; 364/424; 371/16, 18, 23, 24

[56] References Cited

U.S. PATENT DOCUMENTS

| | | | |
|---|---|---|---|
| 3,902,156 | 8/1975 | Hill | 340/931 |
| 3,978,477 | 8/1976 | Schmitz | 340/515 |
| 4,156,132 | 5/1979 | Hazzard | 371/23 |
| 4,200,224 | 4/1980 | Flint | 371/18 |
| 4,293,841 | 10/1981 | Potter | 340/931 |
| 4,308,616 | 12/1981 | Timoc | 371/23 |
| 4,386,427 | 5/1983 | Hosaka | 371/16 |

FOREIGN PATENT DOCUMENTS

| | | | |
|---|---|---|---|
| 23708 | 2/1980 | Japan | 340/931 |

*Primary Examiner*—John W. Caldwell, Sr.
*Assistant Examiner*—Michael F. Heim
*Attorney, Agent, or Firm*—Townsend and Townsend

[57] ABSTRACT

Portable apparatus for checking, in place, a conflict monitor which includes a test signal generator that produces a test signal that is applied to a programmable switch array to develop AC voltages, simulating a malfunctioning traffic signal controller. The apparatus includes timing circuitry that is operable in response to the test signal to determine the time taken by the conflict monitor under check to respond to application of a simulated traffic signal controller malfunction.

20 Claims, 8 Drawing Figures

PORTABLE CONFLICT MONITOR TESTING APPARATUS

BACKGROUND OF THE INVENTION

1. Field of the Invention

The present invention pertains generally to test apparatus. More particularly, the invention relates to portable apparatus capable of simulating a malfunctioning traffic signal controller for checking a system that monitors the operation of traffic signal controllers to determine the operability and response times of the monitoring system.

2. Description of the Prior Art

Pedestrian and vehicular traffic at intersections has, for some time, been controlled by signal lights that are systematically actuated by a central traffic controller. Typically, a source of AC power is switched by load switches operated by the controller in a preprogrammed manner to regulate the orderly flow of traffic through the intersection. The controller effects sequential operation of lights to instruct when to proceed (green or WALK), when to exercise caution (yellow), or when to come to a half (red or DON'T WALK).

Experience has shown that when a traffic controller malfunctions, the least disruption of traffic flow results if the sequencing of the signal lights by the controller is interrupted and the lights caused to flash. A variety of arrangements have been designed to monitor operation of the controller, and to effect transfer of the signal light from a sequencing mode to a flashing mode. Most, if not all, monitoring arrangements operate by monitoring the AC signals that are controlled by the traffic controller to actuate the signal lights. One of the primary functions of a traffic controller monitoring system is to produce a fault indication if two or more permissive but conflicting signal indications are present at the same time. For example, if actuation of one of the green, yellow or WALK signal lights for one direction of a controlled intersection overlaps actuation of one of the green, yellow or WALK signals for an orthogonal direction the monitoring arrangement must be capable of determining whether such overlap is normal or unacceptable; and if determined unacceptable, the monitoring arrangement must be capable of providing a fault indication that can be used by the controller to transfer signal light actuation from the normal preprogrammed mode to a flash mode (e.g., flashing red lights).

In addition, the monitoring system should be able to produce a fault indication when the green, yellow and red signals associated with any one channel are absent for a specified time period. (A channel refers to that group of AC signals sequenced by a controller for actuating the red, green, yellow and WALK signal lights grouped together in one traffic movement). Monitoring systems maintain watch over the AC actuating signals for indications of a faulty load switch, and most are capable of monitoring the 24 VDC from the controller to assure correct operating voltages of the controller, issuing a fault indication when an irregularity is detected.

However, while such monitoring systems, when operating correctly, are available to ensure correct operation of a traffic controller, and to operate to prevent controller malfunction from endangering the public safety, there is presently no known apparatus capable of easily checking the operation and response times of the monitoring system itself.

SUMMARY OF THE INVENTION

Accordingly, the present invention is directed to apparatus capable of easily being transported to the location of a conflict monitor and checking the operation of a monitoring system (hereinafter, "conflict monitor") in place by providing simulated traffic controller signals indicative of a malfunctioning controller. The invention functions to determine whether or not the conflict monitor under test can detect the malfunction, the time taken for detection and to produce a fault indication.

According to the present invention, therefore, a conflict monitor test apparatus is provided generally comprising a controllable switch that receives an AC voltage, similar to that used by a traffic controller to actuate traffic signals, to initiate therefrom a first test signal. The first test signal is communicated to a programmable selection circuit that develops a number of second test signals simulating various traffic controller malfunctions. The programmable selection circuit is adapted to be coupled to a conflict monitor so that the second test signals can be presented thereto.

The test apparatus includes timing circuitry that is capable of being started by the initiation of the first test signal. The test apparatus utilizes the timing circuitry to measure the response time taken by the conflict monitor under test to generate a fault indication, measuring the time period between initiation of the first test signal and the initiation of the occurrence of the fault indication provided by the monitor.

The first test signal produced by the invention can take one of two forms: In a first form the first test signal is an AC voltage that originates at a set point in time; a second form is an AC voltage that terminates at a set point in time. The first form functions to initiate the timing circuitry and to be used as the basis for the second test singals which are made available, via the programmable selection circuit, to the conflict monitor as overlapping, conflicting signal light voltages. The second form, which also initiates the timing circuitry when the AC voltage terminates, is similarly used.

The timing circuitry is adapted to be coupled to the conflict monitor to produce information of the elapsed time taken by the monitor to recognize and respond to a traffic controller malfunction.

Other aspects of the conflict monitor test apparatus of the present invention include a power selection circuit for selecting a variety of AC and DC voltages that are used for testing the conflict monitor. For example, the power selection circuit provides a variable AC voltage to a test signal generator, that includes the controllable switch for use as the first test signal. Thus, the first and second test signals can be some AC voltage other than the typical 120 VAC (60 Hz) signal light-actuating voltages, simulating load switch malfunction. The power selection switch can also generate variable (in amplitude) negative or positive half-wave AC voltages, simulating again a faulty traffic controller load switch, to determine whether the conflict monitor can recognize this type of malfunction and respond with a fault indication.

A major aspect of the invention is its portability. The operating characteristics described above are included in circuit implementations of the present invention that are mounted in an easily transported carrying case.

Thereby, the invention can easily be carried from one location to another, and used at each location to test the operation and response time of conflict monitors without removing the monitor from the controlled intersection.

For a more complete understanding of the invention, including the objects and advantages thereof, reference should be had to the following detailed description and the accompanying drawings wherein there is shown a preferred embodiment of the invention.

DETAILED DESCRIPTION OF THE INVENTION

Figure 1:
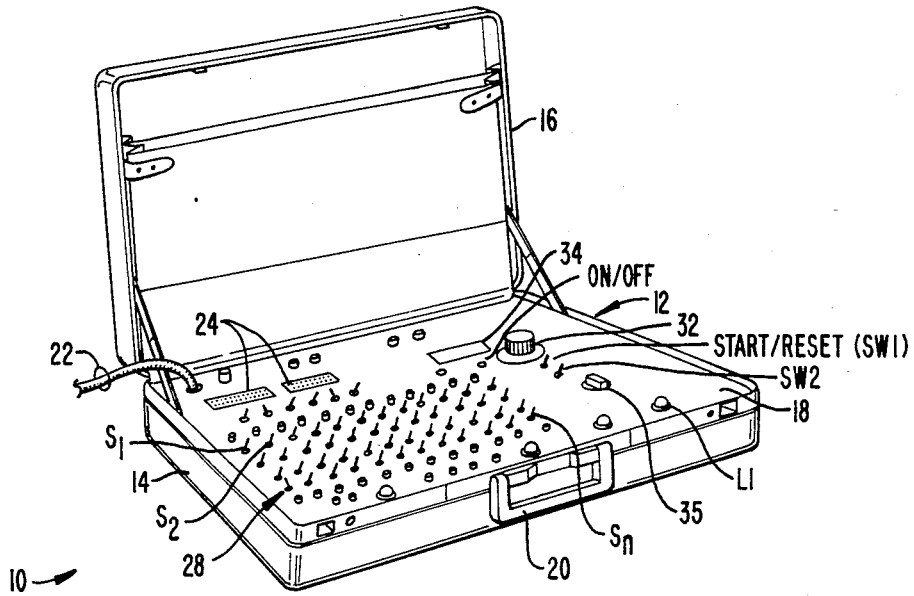
FIG. 1 is a perspective view of the conflict monitor test apparatus of the present invention.

Referring now to the drawings, and particularly FIG. 1, a portable conflict monitor test apparatus is shown designated with the reference numeral 10. As illustrated, the test apparatus 10 includes a carrying case 12, formed from a housing 14 containing the test apparatus itself, and a cover 16 that is hinged to the housing 14 and adapted to close over and protect a control console 18. A handle 20 is provided to allow one to easily carry the test apparatus 10.

An AC power line 22 is provided and adapted to connect the test apparatus 10 to an AC outlet (not shown) typically contained within the structure that houses a traffic controller, supplying an AC current to the electronics housed within the housing 14 of the test apparatus 10.

Female interface connectors 24, attached to the control console 18, are adapted to receive the male ends of a multiwire cable 50 (FIG. 2) whose other end is configured to mate with the connector of a conflict monitor. Signals simulating a traffic signal controller are presented at the interface connectors 24, communicated through the multiwire cable 50 to the conflict monitor being checked. In turn, the multiwire cable 50 communicates fault indications from the conflict monitor back to the test apparatus 10.

Carried by the control console 18 is an array 28 of three-position toggle switches $S_1$–$S_n$ which function to program the type of simulated signals that will be conducted to a conflict monitor. As will be seen, each one of the individual switches $S_1$–$S_n$ of the array 28 functions to select (or not select) a test signal for communication to a conflict monitor. Other controls on the control console include a variac control knob 30 which operates a variac (FIG. 6) to control an AC voltage. A control knob 32 controls a potentiometer to vary various DC voltages, as will be described more fully below. Other of the switches on the control console 18 include a START/RESET switch which operates a timing mechanism that initiates measurement of the response time for the conflict monitor to produce a fault indication in response to receipt and detection of voltages produced by the test apparatus 10, simulating a malfunctioning traffic controller; switches SW2 and SW3 select various DC voltages that are used for test purposes; and ON/OFF power switch. Finally, an LED display 34 is provided to display various response times measured by the test apparatus 10.

Figure 2:
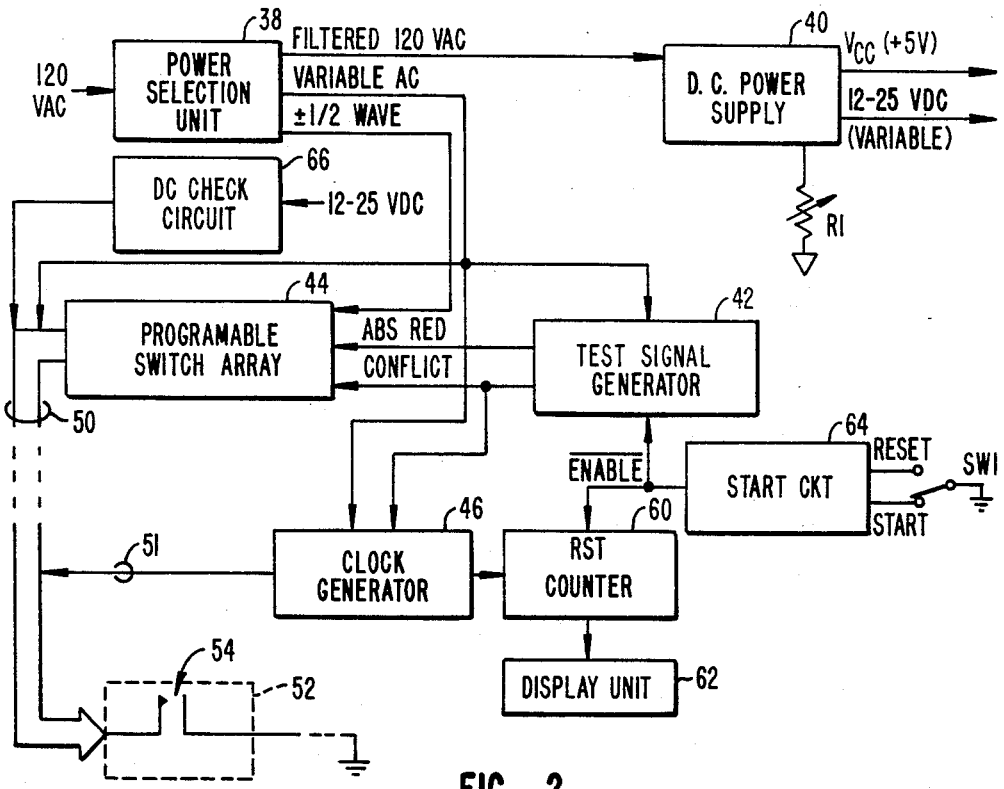
FIG. 2 is a block diagram of the circuitry used to implement the conflict monitor test apparatus of the present invention.

Turning now to FIG. 2, there is illustrated the block diagram of the circuitry housed within the cabinet 14 for producing the various simulated traffic signal controller signals. As shown, the circuitry includes a power selection unit for receiving 120 VAC from a power source (not shown) via the power line 22, and for producing therefrom a filtered 120 VAC voltage, a variable AC voltage, and a positive or a negative ± half-wave voltage.

The filtered 120 VAC voltage is supplied to a DC power supply 40 that includes a potentiometer R1. The DC power supply 40 produces a supply voltage $V_{CC}$ (typically +5 volts) and a DC voltage capable of being varied by the potentiometer R1 from 12 VDC to 25 VDC.

The variable AC voltage produced by the power selection unit 38 is applied to a test signal generator 42. The test signal generator 42 converts the variable AC voltage to a CONFLICT test signal and an absence of red (ABS RED) test signal, both of which, in effect, are gated versions of the variable AC voltage received from the power selection unit 38. As will be seen, the power selection unit 38 includes a variac whose output provides the variable AC voltage. Accordingly, the variable AC voltage can vary from 135 VAC (60 Hz) to substantially zero volts, depending upon the variac selection.

The CONFLICT and ABS RED test signals produced by the test signal generator 42 are applied to a programmable switch array 44, which includes the array of three-position toggle switches $S_1$–$S_n$ (FIG. 1) and to a clock generator circuit 46. The programmable switch array 44 connects to the interface connectors 24 to which, in turn, is adapted to be connected the multiwire cable 50. The cable 50 is meant to be connected to a conflict monitor (illustrated in representative fashion by the dashed lines, and designated with the reference numeral 52) for communicating a number of different test voltages, developed from the CONFLICT and ABS RED test signals to the conflict monitor 52.

Cable 50 also communicates the variable AC voltage to the conflict monitor 52. The variable AC is used by the conflict monitor as a source of operating power. Varying this voltage source checks to see that the operability of the monitor is within its design limits (i.e., that response times do not vary significantly).

Typically, conflict monitors presently on the market include a set of normally open contacts 52 controlled by an electromagnetic relay mechanism (not shown). During operation, if the conflict monitor 52 detects an error condition, such as concurrent green and yellow traffic signals (for a time period typically greater than 450 ms), or the absence of certain traffic signal voltages, or other fault conditions, a fault indication is provided by the conflict monitor in terms of closure of the contacts 54. This allows a traffic signal controller to use closure of contacts 54 to place the signal lights in a flashing mode. In the present invention, multiwire cable 50 includes a signal line 51 that establishes a connection with the contacts 54, allowing the test apparatus 10 to detect the closure of contacts 54, and used to determine response time of the conflict monitor 52 in a manner described below.

The CONFLICT test signal is also applied to a clock generator 46 which responds to appearance of the CONFLICT test signal to produce a timing signal, in the form of a periodic digital pulse train, that operates a digital counter 60. The content of the counter is applied to a display unit 62, which includes the LED display 34.

Finally, still referring to FIG. 2, a DC check circuit 66 is included in the test apparatus. DC check circuit 66 receives the 12–25 VDC produced by the DC power supply 40 and selectively provides DC test voltages to the conflict monitor via the cable 50, as will be explained below.

Briefly, the circuit of FIG. 2 operates in the following manner: In response to manual actuation of the START/RESET, a start circuit 64 produces an $\overline{\text{ENABLE}}$ signal that is applied to the reset (RST) of counter 60, removing the counter from a reset state and placing it in a condition that allows it to count pulses provided by the clock generator 46. At the same time, the $\overline{\text{ENABLE}}$ signal is received by the test signal generator 42 and used to gate the variable AC signal to the programmable switch array 44 as the CONFLICT and ABS RED signals.

Prior to the $\overline{\text{ENABLE}}$ signal, the CONFLICT signal is in an inactive state (i.e., substantially zero volts). At a time equal to or shortly after appearance of the e,ovs-/ENABLE/ signal, the variable AC voltage is gated at substantially the zero-crossing of that voltage as the CONFLICT signal.

The switches $S_1$–$S_n$ (FIGS. 1 and 7) of the programmable switch array 44 are preset to establish a desired traffic signal conflict (i.e., green-green, green-yellow, or the like) so that appearance of the CONFLICT is immediately presented to the conflict monitor 52 as a simulated traffic controller malfunction. Appearance of the CONFLICT signal is detected by the clock generator 46, which responds by gating the timing signal that is applied to the counter 60. The counter 60 will begin counting, and continue to count, until the timing signal produced by the clock generator 46 is terminated. Termination of the timing signal is caused by presence of a fault indication produced by the conflict monitor 52 - in the form of closure of the contacts 54. When the timing signal terminates, the counter is left with a content that indicates the time it took the conflict monitor 52 to respond to the simulated malfunction by closing contacts 54. The counter content is displayed by the display unit 62.

As indicated above, certain conflict monitors on the market today are capable of sensing absence of any signal light voltages beyond an acceptable period of time (typically one second) and responding with a fault indication (i.e., closure of contacts 54). For these monitors, the present invention provides the ABS RED test signal which operates as follows: The programmable switch array 44 is set to conduct the ABS RED test signal to the conflict monitor 52 via the multiwire cable 50 as the RED, YELLOW and GREEN actuating voltages for a single signal head. In response to the $\overline{\text{ENABLE}}$ signal (again, manually initiated by actuation of the START/RESET switch SW1 and the start circuit 64) the test signal generator 42 will terminate the ABS RED signal (at substantially the zero-crossing of the variable AC voltage). Termination of the ABS RED is detected by the clock generator 46, which initiates the timing signal that is applied to the counter 60. Again, as with the CONFLICT signal, the counter 60 will determine the response time of the conflict monitor 52 to the simulated malfunction condition imposed by termination of the ABS RED test signal (and its conversion by the programmable switch array 44 as a failure of one signal light channel). The clock generator 46 will detect closure of the contacts 54 in the conflict monitor 52 and terminate the timing signal, leaving the counter 60 in a state that is indicative of the conflict monitor's response time. The content of the counter is displayed in human-readable form by the display unit 62.

Figure 3:
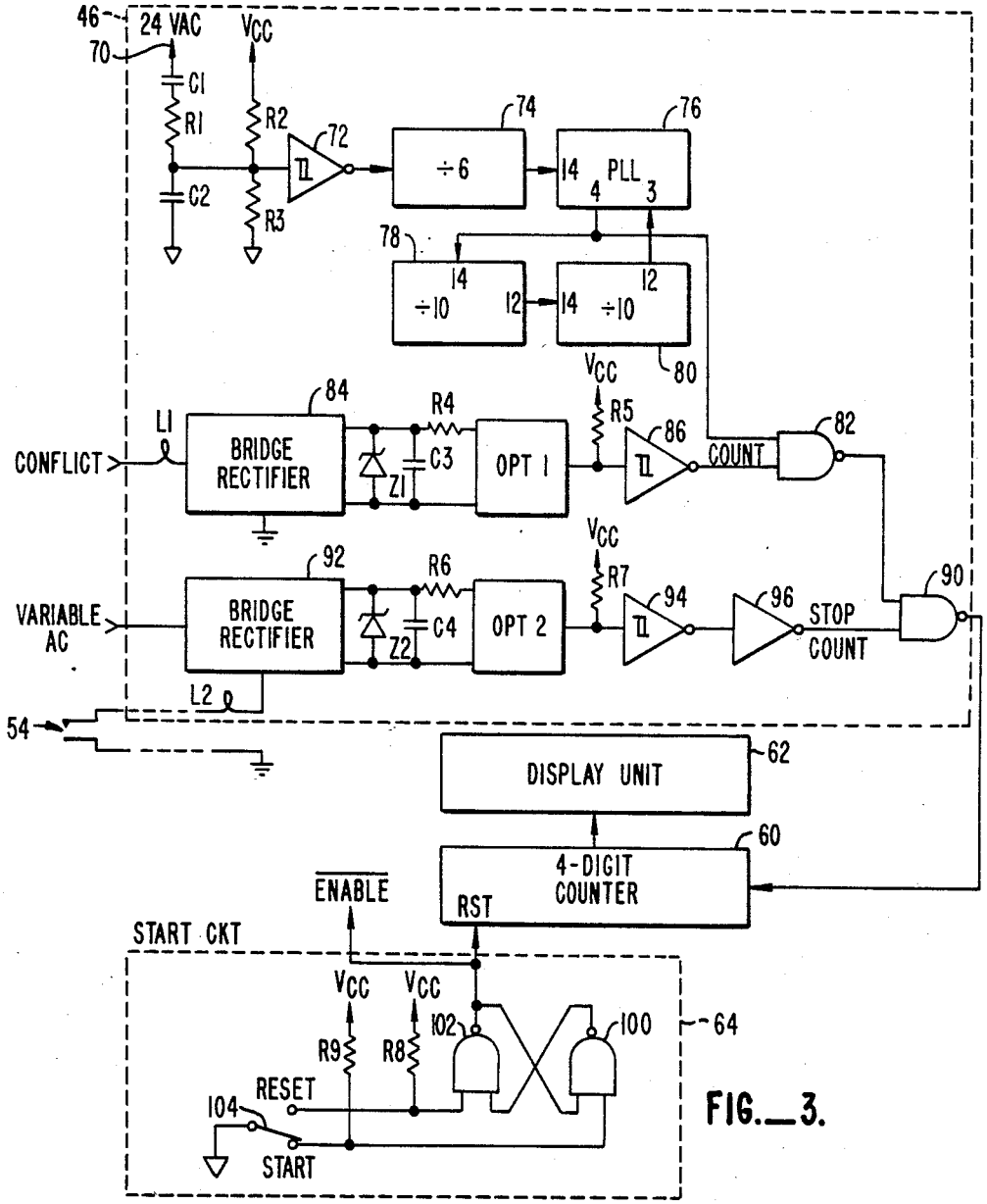
FIG. 3 is a logic diagram of the clock generator and counter circuits.

Referring now to FIG. 3, the clock generator 46 and start circuit 64 are illustrated in greater detail. As shown, the clock generator 46 receives a 24 VAC portion of the filtered 120 VAC (via a transformer —not shown) at terminal 70. A resistor/capacitor network consisting of capacitors C1 and C2, and resistors R1, R2, and R3 condition the filtered 24 VAC voltage for application to a Schmidt trigger device (a 74C14N) 72 that performs wave-shaping functions to sharpen the rise and fall times of the applied sinusoidal signal to produce a period, 60 Hz square wave. This 60 Hz square wave is applied to a divide-by-6 circuit 74 to produce a 10 Hz signal. The 10 Hz signal is coupled from the divide-by-6 circuit 74 and applied to a phaselock loop (PLL) circuit 76. Two divide-by-10 circuits 78 and 80 operate in conjunction with the PLL circuit 76 to ultimately produce, at pin 4 of the PLL circuit 76, a 1 KHz timing signal that is applied to one input of a two-input NAND gate 82.

The second input of the two-input NAND gate receives a COUNT signal that is developed from, and is indicative of, presence of the CONFLICT test signal produced by the test signal generator 42 (FIG. 2). The circuitry producing the COUNT signal includes a full-wave bridge rectifier 84, a zener diode Z1, a resistor R4 capacitor C3, an optical coupler OPT1, and a Schmidt trigger device 86.

The CONFLICT signal, when present, is applied to the bridge rectifier 84 via a load lamp L1 to the bridge rectifier 84. The load lamp L1 serves three purposes: It limits current flow; it provides an indication of the presence of the CONFLICT test signal; and, perhaps most importantly, it provides a low initial impedance to improve the rise time of the voltage on capacitor C3. The CONFLICT test signal is rectified by the bridge rectifier 84, and limited to approximately 4.7 volts DC by the zener diode Z1, is coupled to the optical coupler OPT1. The optical coupler OPT1 is used as an isolation device to provide buffered signal isolation. The output of the optical coupler OPT1 is applied to the Schmidt trigger device 86 to standardize and speed the rise and fall times, and appears as the COUNT signal that is used to enable communication of the timing signal via the NAND gate 82 to a second two-input NAND gate 90.

The other input of the NAND gate 90 receives a STOP COUNT signal that, when in a logic ONE state, causes the timing signal to be passed to the counter 60.

When the STOP COUNT signal is a logic ZERO, the NAND gate 90 is disabled, and communication of the timing signal to the counter 60 is terminated.

The STOP COUNT signal is produced by circuitry substantially similar to that used to produce the COUNT signal, and includes a bridge rectifier 92, at the output of which is coupled a zener diode Z2, a capacitor C4, and a resistor R6. The bridge rectifier 92 receives the variable AC voltage and, via the signal line 51 (which is a part of the multiwire cable 50—FIG. 2) utilizes the contact points 54 (a part of the conflict monitor 54 being checked—see FIG. 2) to detect fault indications produced by the conflict monitor 52. A load lamp L2 is included in the ground line of the bridge rectifier 92 (which includes the contact points 54) for the same three purposes that load lamp L1 is included, as outlined above. When the contact points 54 are open (an indication of no fault produced by the conflict monitor) the bridge rectifier 92 produces no noticeable output. However, when the contact points 54 close a circuit path through the bridge rectifier 92 is established and the bridge rectifier 92 outputs a DC voltage (limited by zener diode Z2 to approximately 4.7 volts DC) to the optical coupler OPT2. The output of the optical coupler OPT2 is applied to a Schmidt trigger 94, whose output, in turn, is inverted by an inverter 96 to produce the STOP COUNT signal.

FIG. 3 also illustrates the circuitry implementing the start circuit 64, which includes a pair of NAND gates 100, 102, cross-coupled to form a set-reset flipflop. One input of each of the NAND gates 100, 102 is connected to a corresponding one of the terminals of the START/RESET switch SW1. Switch SW1 selectively (by manual operation) couples a ground potential to the NAND gates 100, 102 to set or reset the flipflop formed thereby. Pull-up resistors R8, and R9 couple the corresponding inputs of the NAND gates 100, 102 to the supply voltage $V_{CC}$.

SW1 functions to bring into existence or terminate the $\overline{\text{ENABLE}}$ signal. When the switch arm 104 of SW1 is connected to the RESET terminal, the cross-coupled NAND gate flipflop is set, and the output of the NAND gate 102 is forced HIGH. The output of the NAND gate 102 is applied to the reset (RST) of the counter 60 to hold it in a reset, non-counting state. When the switch arm 104 of SW1 is switched to the START terminal, the output of the NAND gate 102 goes LOW, placing the counter 60 in an enabled, ready state. In addition, the output of the NAND gate 102, which is the e,ovs/ENABLE/ signal, will enable the test signal generator 42 (FIGS. 2 and 4).

Figure 4:
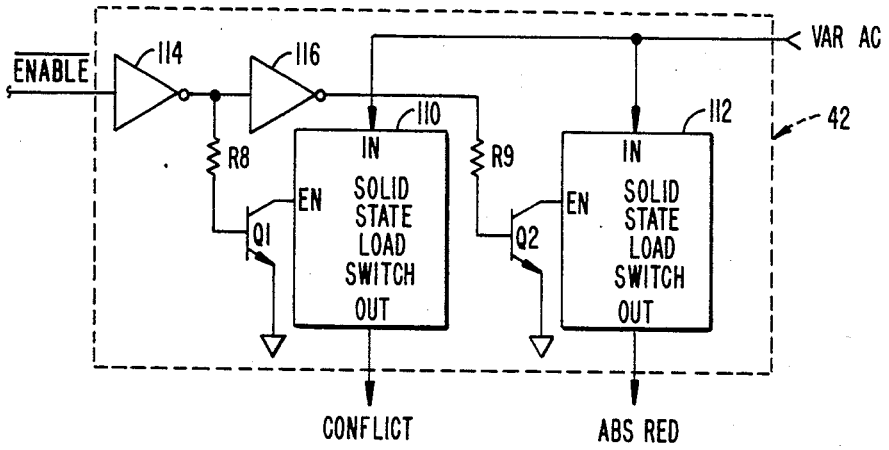
FIG. 4 is a schematic diagram of the test signal generator.

Illustrated in FIG. 4 is the test signal generator 42, shown as comprising a pair of solid-state load switches 110, 112 together with enabling circuitry comprising inverters 114, 116 and transistor switches Q1 and Q2. The e,ovs/ENABLE/ signal is received by the inverter 114, inverted, and applied, via resistor R8, to the base terminal of resistor Q1. The emitter lead of the transistor Q1 is grounded and the collector lead is connected to the enable (EN) input of the solid-state load switches 110. The variable AC voltage is applied to the input (IN) of the solid-state load switch 110.

Figure 5:
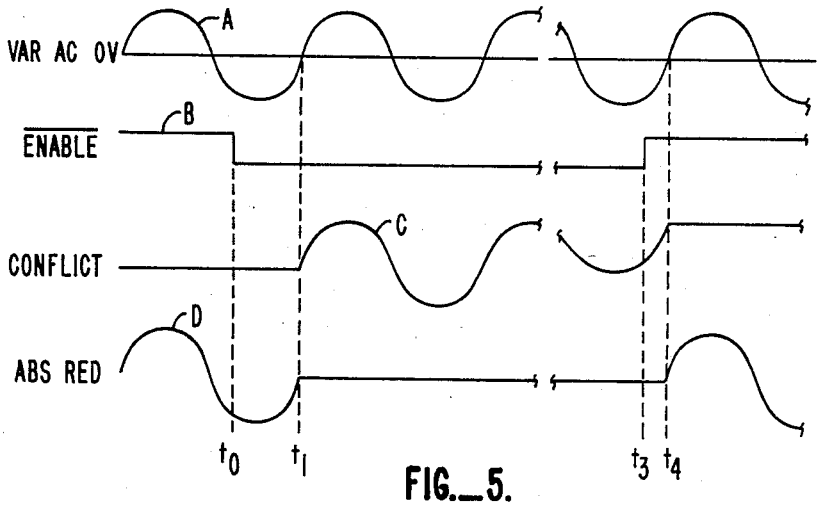
FIG. 5 is a timing diagram illustrating operation of the test signal generator of FIGS. 2 and 4 in the production of the test signal.

Solid-state load switches 110 and 112 are solid-state relays employing zero-crossing switching (PN/S3012A). Both function to couple an AC voltage from their inputs (IN) to their outputs (OUT) at a zero-crossing of that voltage when a conducting path is established at their respective enable (EN) inputs. For example, when the $\overline{\text{ENABLE}}$ signal goes LOW, the base terminal of the transistor Q1 will be pulled HIGH by the output of inverter 114, placing the transistor Q1 in a conducting state and enabling the solid-state load switch 110. At the next zero-crossing of the variable AC voltage, the CONFLICT signal will appear. This is illustrated in FIG. 5 with waveforms A, B and C, respectively representing the variable AC voltage, the e,ovs/ENABLE/ signal, and the CONFLICT test signal. As illustrated, the e,ovs/ENABLE/ signal experiences a HIGH to LOW excursion at time $t_0$. Sometime after time $t_0$, at time $T_1$, the variable AC voltage will cross zero volts, at which time the solid-state load switch 110 gates variable AC voltage to its output (OUT), where it appears as the CONFLICT test signal. The CONFLICT test signal remains until the $\overline{\text{ENABLE}}$ goes HIGH at time $t_3$, causing the transistor Q1 to cease conduction. At the next zero-crossing of the variable AC voltage (i.e., at time $T_4$) the CONFLICT test signal terminates.

The solid-state load switch 112 operates in a similar manner: When the $\overline{\text{ENABLE}}$ signal is brought LOW (time $t_0$), the ABS RED test signal terminates at the zero-crossing of the variable AC voltage following time $t_0$ (i.e., time $t_1$). When the $\overline{\text{ENABLE}}$ signal goes HIGH (time $t_3$) th ABS RED test signal appears at the next zero-crossing ($t_4$).

Figure 6:
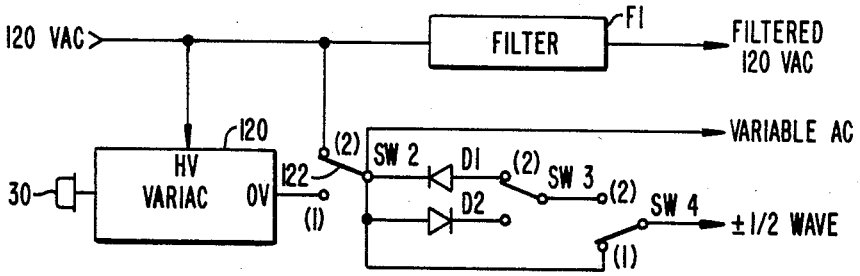
FIG. 6 is a schematic diagram of the circuitry used to provide various of the AC voltages used by the present invention.

Referring now to FIG. 6, the power selection unit 38 is illustrated in greater detail, and shown as including a variac 120, switches SW2–SW4, a filter F1, and diodes D1, D2. The variac 120 is a conventional variable auto transformer of the type having a tap that is adjustable by the control knob 30 to adjust the turns ratio of the transformer to provide control of an (AC) output voltage. The variac 120 receives the 120 VAC line voltage at its high voltage (HV) input, and provides adjustable voltage at its output (OV). The LV output is coupled to terminal pin (1) of switch SW2. The terminal pin (2) of SW2 is connected to the 120 VAC line voltage. Switch arm 122 switches between the two terminals of switch SW2 to select either the full 120 VAC voltage or the version of the 120 VAC voltage supplied by the variac 120.

Switch SW2 is coupled to a terminal (2) of switch SW3 by diode D1. The diode D1 functions to pass the negative half-wave of the AC voltage coupled by switch SW2. In similar fashion, a diode D2, which is connected in opposition to the way diode D1 is connected, passes the positive half-wave of the AC voltage coupled to switch SW2.

The switch SW3 is connected to terminal (2) of switch SW4, whose terminal (1) is connected to switch SW2.

The variable AC signal is taken from the switch SW2 and, as indicated, can comprise either the 120 VAC line voltage or the AC voltage produced by the variac 120. Thus, the CONFLICT and ABS RED test signals can be, when present, an AC voltage greater than, equal to, or less than the 120 VAC, depending upon the tab setting of variac 120.

The $\pm\frac{1}{2}$ WAVE signal can take on one of four forms: (1) 120 VAC line voltage, (2) the AC voltage produced by the variac 120, (3) the negative half-waves of either (1) or (2), or (4) the positive half-waves of (1) or (2). The $\pm\frac{1}{2}$ WAVE signal functions to simulate a defective load switch which can, when malfunctioning, produce any one of the aforementioned AC voltages.

Figure 7:
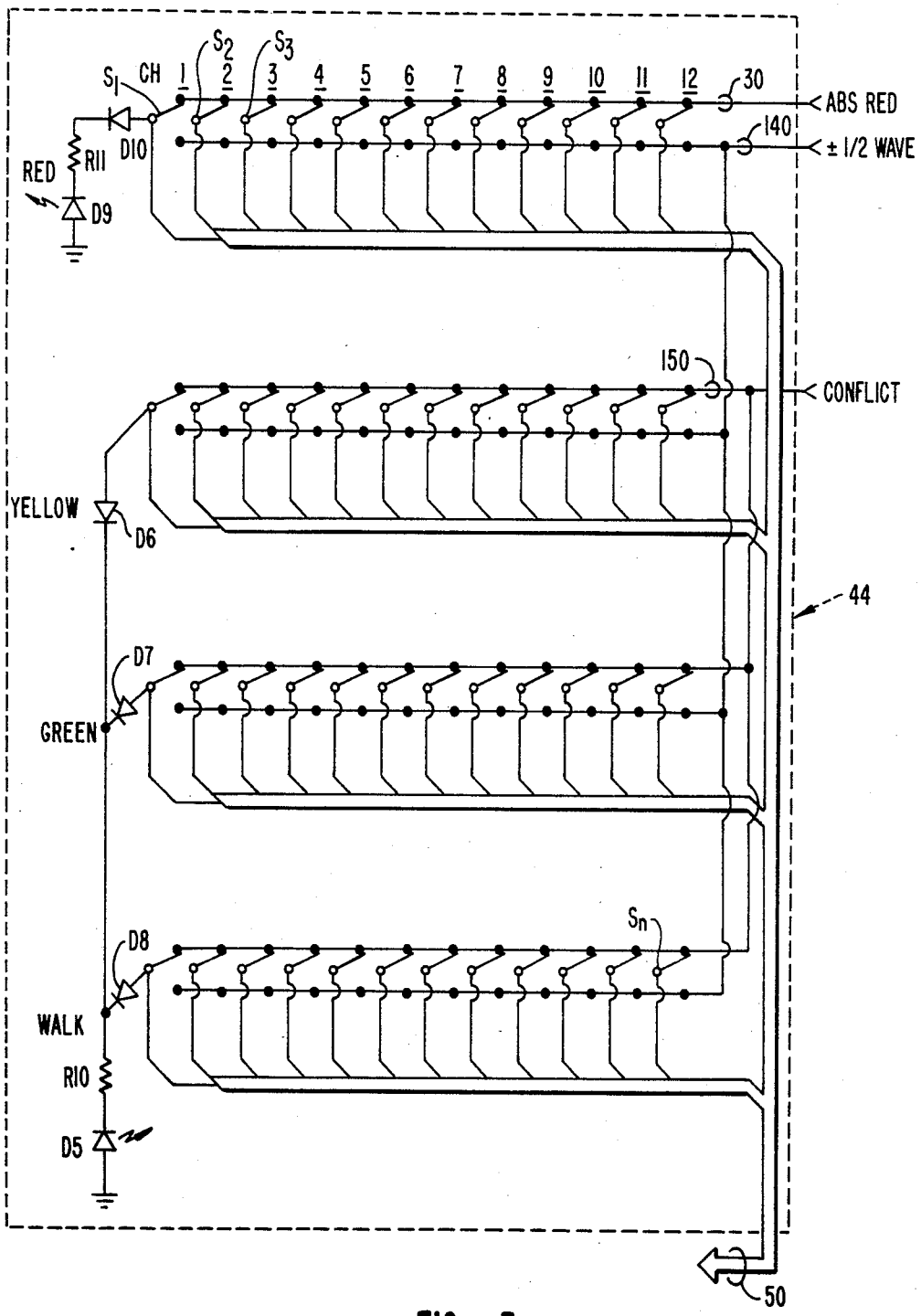
FIG. 7 is a schematic diagram of a switch array used to form the programmable selection circuit used in the present invention to convert the test signal produced by the test signal generator to a simulated traffic controller malfunction signal or signals.

Illustrated in FIG. 7, in schematic form, is the configuration of the programmable switch array 44. As shown, the programmable switch array comprises a plurality of single-pole, double-throw, center-off (three-position) switches $S_1$–$S_n$ (here, n equals 48) arranged in four row, twelve column matrix. Each column corresponds to one channel of signal light-actuating voltages (RED, YELLOW, GREEN and WALK) monitored by the conflict monitor to be tested.

The switch arms of each of the switches $S_1$–$S_n$ connect to a corresponding one of signal lines forming the multiwire cable 50. In addition, each channel is coupled to a light-emitting diode via isolation diodes. Only those for channel one are shown for obvious reasons of clarity. As shown, those switches $S_1$–$S_n$ corresponding to the YELLOW, GREEN and WALK rows of the CH1 column are respectively coupled to an LED D5 via a resistor R10 by isolation diodes D6, D7 and D8. In similar fashion, the corresponding switch for the RED row, CH1 column (switch S1) is coupled to LED D9 by isolation diode D10 and resistor R11.

Each of the switches functions to switch between one of three positions. Referring first to the RED row, each switch can be used to electrically connect its associated signal line (i.e., one of those forming cable 50) to the bus 130, to a bus 140, or to no connection. Note that bus 130 receives the ABS RED test signal, and that bus 140 receives the $\pm\frac{1}{2}$ wave voltage.

In a similar manner, those switches $S_1$–$S_n$ that are used to form the YELLOW, GREEN and WALK rows of the matrix are connected to select between the CONFLICT test signal (bus 150), the $\pm\frac{1}{2}$ wave voltage (bus 140), or no connection for communication to a conflict monitor via the multiwire cable 50. The generation of the CONFLICT and ABS RED test signals has been described above. The use of clock generator 46 and counter 60 (FIGS. 2 and 3) has also been discussed in connection with measuring the elapsed time taken by a conflict monitor being tested to respond to signals simulating a malfunctioning traffic controller. The array of switches $S_1$–$S_n$ of FIG. 7 functions to develop the necessary malfunction simulation from the CONFLICT or the ABS RED test signals.

For example, to determine a conflict monitor's response to a conflict, the system is reset via switching SW1 to the RESET position, the CH1-YELLOW and the CH3-YELLOW switches set to connect to bus 150, and all remaining switches set to a no connection position. The switch SW1 is set to the START position, causing appearance of the CONFLICT test signal and initiation of time measurement by clock generator 46 and counter 60. If the monitor is operating properly (under these conditions) a fault indication will occur and display unit 62 will display a time value less than, typically, 450 ms. In the same manner, other switch combinations can be set to select other conflict conditions.

Alternatively, a switch $S_1$–$S_n$ can select the $\pm\frac{1}{2}$ wave voltage and the power selection unit 38 set to any of the available test voltages, simulating various failure modes of a load switch, to again test the response of the conflict monitor under test.

Figure 8:
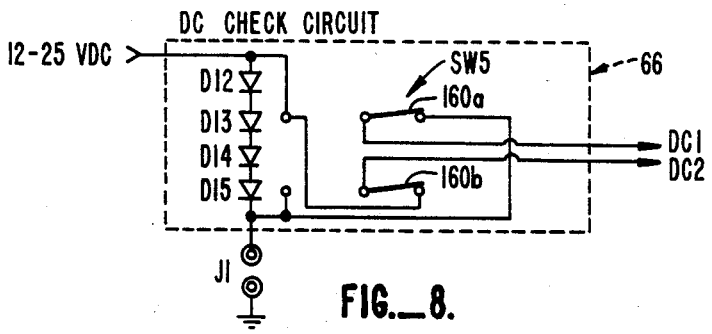
FIG. 8 is a schematic diagram of the DC check circuit used to provide a variable pair of DC voltages with a 2.4 VDC difference between them.

Illustrated in FIG. 8 is the schematic detail of the DC check circuit 66. As shown, the DC check circuit includes a stack of four series-connected diodes D12, D13, D14 and D15, and a double-throw, double-pole, center-off switch SW5. The DC check circuit receives the variable 12–25 VDC from the DC power supply 40. When a current flows through the diodes D12–D15, a voltage of approximately 2.4 volts will be dropped across the diode stack. The diodes D12–D15, in combination with the switch SW5, will provide two voltages: DC1 and DC2, each 2.4 volts different from the other. Which of the voltages DC1, DC2 is the higher depends upon the position of switch arms 160*a* and 160*b*.

Certain conflict monitors include provision for monitoring one or more 24 VDC power supplies for providing sources of 24 VDC used by the traffic controller for operating the load switches that switch an alternating voltage to actuate the controlled lights or other external logic. If these 24 VDC supply voltages drop below approximately 18 VDC, the conflict monitor (if operating properly) provides a fault indication. The trip point for determining a 24 VDC supply malfunction by the conflict monitor is typically not exactly 18 VDC; rather, depending upon the particular monitor in question, the trip point will be somewhere in the range of 18–20 VDC. This is the reason for the two test voltages, DC1 and DC2. Using a single variable DC power supply, one voltage can be held higher than the other while both are lowered to determine the trip voltage of the monitor under test; the voltages (DC1 and DC2) can be reversed and the check can run again to check another of the conflict monitor's 24 VDC monitor channels (if two or more are provided by the monitor).

The DC check circuit operates as follows: The 12–25 VDC is used at approximately 24 VDC (by varying potentiometer R1—FIG. 2—which is operated by control knob 35—FIG. 1) during normal operation. When it is desired to check the 24 VDC monitoring capability of the conflict monitor, potentiometer R1 is varied to drop the 12–25 VDC. Assume switch SW5 is in the position shown in FIG. 8. The voltages DC1 and DC2 will also drop accordingly, with voltage DC1 being 2.4 volts lower than voltage DC2. the voltage DC1 is monitored by a conventional volt meter (not shown) plugged into jack J1. If the voltage DC1 drops below a predetermined DC level (typically 18 volts DC) without a fault indication from the monitor, it is determined that the 24 VDC channel of the conflict monitor under test is bad. If a fault indication is produced when the DC1 voltage is in a predetermined range (typically 18 VDC–20 VDC) the 24 VDC channel-receiving DC1 is determined to be operable.

The 12–25 VDC is returned to approximately 24 VDC and the switch arms 160*a* and 160*b* switched so that the DC1 voltage is the higher voltage, and the above procedure repeated so that the channel of the conflict monitor under test receiving the voltage DC2 is checked.

One final matter: At present there is no standardization among the conflict monitors on the market today as to what connector pins receive or provide what signals. Thus, the present invention must be accompanied by a connector cable 50 that is specifically constructed to communicate the proper signals, voltages, and grounds to and from the particular conflict monitor to be checked.

I claim:

1. Apparatus for simulating a malfunctioning traffic signal control for testing response times and operability of a conflict monitor of the type adapted to receive traffic controller signals from a traffic signal controller and to provide an indication of traffic signal controller and upon detection of such malfunction, the apparatus comprising:

circuit means for producing an enable signal;

switch means coupled to the circuit means for receiving the enable signal for initiating a test signal in response to the enable signal;

selection means adapted to be coupled to the conflict monitor for receiving the test signal to develop therefrom simulated traffic controller signals representative of a malfunctioning traffic controller for communication to the conflict monitor;

generating means coupled to the switch means and responsive to initiation of the test signal for generating a timing signal, the generating means including means adapted to receive said indication of traffic signal controller malfunction to terminate the timing signal upon receipt thereof; and counter means coupled to the generating means to receive the timing signal and to produce therefrom indicia of a response time of the conflict monitor.

2. The apparatus of claim 1, wherein the test signal is substantially zero volts before receipt of the enable signal by the switch means and an alternating voltage after receipt of the enable signal by the switch means.

3. The apparatus of claim 1, wherein the test signal is an alternating voltage before receipt of the enable signal by the switch means and substantially zero volts after receipt of the enable signal by the switch means.

4. The apparatus of claim 1, wherein the switch means is operable to receive an alternating voltage and to communicate the alternating voltage as the test signal upon receipt of the enable signal by the switch means.

5. The apparatus of claim 4, wherein the switch means includes second circuit means responsive to the enable signal to initiate the test signal at the first zero-crossing of the alternating voltage after receipt of the enable signal by the switch means.

6. The apparatus of claim 5, wherein the second circuit means includes a solid-state load switch for receiving the alternating voltage and for initiating the test signal.

7. The apparatus of claim 1, wherein the test signal is an alternating voltage, and wherein the switch means is operable to terminate the test signal at a predetermined voltage level obtained after appearance of the enable signal.

8. The apparatus of claim 2, wherein the switch means is a solid-state load switch.

9. The apparatus of claim 1, wherein the simulated traffic controller signals are in the form of a plurality of AC voltages, and wherein the selection means includes means for selectively communicating the AC voltages as predetermined combinations of green, yellow or walk traffic control signals to simulate traffic signal conflicts.

10. The apparatus of claim 9, wherein the selection means includes means for selectively communicating the test signal as a simulated red traffic control signal, and wherein the switch means is operable to terminate the test signal at a predetermined voltage level after receipt of the enable signal by the switch means.

11. The apparatus of claim 1, and wherein the test signal is an alternating voltage; and wherein the generating means includes first rectifier means for receiving the test signal to produce therefrom a start signal indicative of presence of the test signal, and gating means for receiving and communicating the timing signal to the counter in response to presence of the start signal.

12. The apparatus of claim 11, wherein the gating means includes an optical isolation device coupled to the first rectifier means and responsive thereto for producing the start signal.

13. The apparatus of claim 11, the generating means including second rectifier means responsive to an alternating voltage and to the indication of traffic signal controller malfunction to produce a gating signal during presence of said indication to terminate communication of the timing signal.

14. Apparatus for testing the response time and operability of a conflict monitor, the conflict monitor being of the type for monitoring a traffic signal controller and adapted to provide a fault indication upon occurrence of traffic signal controller malfunction, the apparatus comprising:

means for initiating a first test signal at a selectable point in time;

means for receiving and selectively communicating the test signal to the conflict monitor as a plurality of simulated traffic signal controller malfunctions;

means adapted to detect the indication of fault provided by the controller and to produce therefrom indicia representing a response time of the conflict monitor detection of traffic signal controller malfunction.

15. Apparatus for providing test signals that simulate operation of a traffic signal controller for testing a conflict monitor response, the conflict monitor being of the type operable to produce a fault signal in response to detection of indications of traffic control signal conflicts, the apparatus comprising:

first circuit means for providing a plurality of simulations of said indications of traffic signal controller conflicts;

second circuit means adapted to receive the fault signal from the conflict monitor; and third circuit means coupled to the first and second circuit means and responsive to the simulations and the fault signal to produce therefrom an indication of response time operability of the conflict monitor; and coupling means adapted to interconnect the apparatus and the conflict monitor to one another for communicating the simulations and the fault signal therebetween.

16. The apparatus of claim 15, wherein the first circuit means includes means for selecting at least one of the simulations for communication to the conflict monitor.

17. The apparatus of claim 16, wherein the first circuit means includes a test signal generating means for providing a test signal that originates at or after a predetermined point in time, the first circuit means including means for developing the simulations from the test signal.

18. The apparatus of claim 17, the first circuit means being adapted to receive a first alternating voltage and including means for originating the test signal at the first zero-crossing of the first alternating voltage.

19. The apparatus of claim 17, wherein the test voltage is substantially zero volts before the predetermined point in time and an alternating voltage after the predetermined point in time.

20. The apparatus of claim 15, including supply means for providing a variable DC voltage, and DC check circuit means for receiving said variable DC voltage for producing therefrom a number of said plurality of simulated traffic controller malfunctions in the form of at least a pair of DC test voltages that differ from one another by a predetermined voltage.

* * * * *